US010237922B2

(12) United States Patent
Kagaya et al.

(10) Patent No.: US 10,237,922 B2
(45) Date of Patent: Mar. 19, 2019

(54) ELECTRICALLY-HEATED WINDOW SHEET MATERIAL

(71) Applicant: AGC Inc., Tokyo (JP)

(72) Inventors: Osamu Kagaya, Tokyo (JP); Hiromasa Tominaga, Tokyo (JP); Tomohiro Takahashi, Tokyo (JP)

(73) Assignee: AGC Inc., Tokyo (JP)

( * ) Notice: Subject to any disclaimer, the term of this patent is extended or adjusted under 35 U.S.C. 154(b) by 603 days.

(21) Appl. No.: 14/801,318

(22) Filed: Jul. 16, 2015

(65) Prior Publication Data

US 2015/0319809 A1 Nov. 5, 2015

Related U.S. Application Data

(63) Continuation of application No. PCT/JP2014/051150, filed on Jan. 21, 2014.

(30) Foreign Application Priority Data

Jan. 21, 2013 (JP) ..... 2013-008783

(51) Int. Cl.

| | |
|---|---|
| ***H05B 3/06*** | (2006.01) |
| ***H05B 3/84*** | (2006.01) |
| ***H05B 3/02*** | (2006.01) |
| ***H05B 3/20*** | (2006.01) |

(52) U.S. Cl.

CPC ..... *H05B 3/84* (2013.01); *H05B 3/023* (2013.01); *H05B 3/20* (2013.01);

(Continued)

(58) Field of Classification Search

CPC ..... H01M 10/052; H01M 10/0525; H01M 2004/021; H01M 2220/30; H01M 4/131;

(Continued)

(56) References Cited

U.S. PATENT DOCUMENTS 2,557,983 A * 6/1951 Linder ..... C03C 17/3411 106/1.14
5,867,129 A * 2/1999 Sauer ..... B32B 17/10036 343/704

(Continued)

FOREIGN PATENT DOCUMENTS

EP 1 168 888 A2 1/2002
EP 1 331 089 A1 7/2003

(Continued)

OTHER PUBLICATIONS

International Search Report dated Apr. 15, 2014 in PCT/JP2014/051150, filed Jan. 21, 2014.
U.S. Appl. No. 14/800,749, filed Jul. 16, 2015, Kagaya, et al.

*Primary Examiner* — Dana Ross
*Assistant Examiner* — Joseph Iskra
(74) *Attorney, Agent, or Firm* — Oblon, McClelland, Maier & Neustadt, L.L.P.

(57) ABSTRACT

A sheet includes a conductive film, and bus bars including an upper and lower bus bars connected to upper and lower sides of the conductive film. The conductive film includes a recess, a first region between the upper bus bar and the lower bus bar, a second region that is another region between the upper and lower bus bars, and openings in the first region. The upper or lower bus bar is formed along a side of the conductive film including the recess. The first region is between a bus bar at which the recess is positioned and another bus bar facing the recess. A distance between the upper and lower bus bars is shorter in the first region than in the second region. The openings are formed in an upper or a lower part of the first region on a side of the another bus bar.

20 Claims, 13 Drawing Sheets

(52) U.S. Cl.
CPC .. *H05B 2203/002* (2013.01); *H05B 2203/013* (2013.01); *H05B 2203/037* (2013.01)

(58) Field of Classification Search
CPC ..... H01M 4/133; H01M 4/134; H01M 4/366; H01M 4/386; H01M 4/387; H01M 4/505; H01M 4/525; H01M 4/5825; H01M 4/587; Y02E 60/122; Y02T 10/7011; H05B 2203/002; H05B 2203/013; H05B 2203/037; H05B 3/023; H05B 3/20; H05B 3/84
USPC ..... 219/522; 343/713, 704, 909, 767, 711, 343/768; 428/155, 172, 209, 213
See application file for complete search history.

(56) References Cited

U.S. PATENT DOCUMENTS 6,559,419 B1 * 5/2003 Sol ..... B32B 17/10192 219/203
6,765,177 B2 * 7/2004 Noguchi ..... B32B 17/10036 219/203
2002/0015824 A1 * 2/2002 Kawamoto ..... B32B 17/10036 428/156
2003/0150848 A1 8/2003 Noguchi et al.
2004/0107641 A1 6/2004 Walton et al.
2004/0200821 A1 * 10/2004 Voeltzel ..... B32B 17/10036 219/203
2005/0089691 A1 4/2005 Noguchi et al.
2006/0010794 A1 1/2006 Walton et al.
2007/0187382 A1 8/2007 Mauser

FOREIGN PATENT DOCUMENTS

EP 1 404 153 A1 3/2004
EP 1 466 877 A1 10/2004
GB 2 381 179 A 4/2003
JP 60-195251 U 12/1985
JP 3-25355 U 3/1991
JP 2008-056225 A 3/2008
JP 2010-251230 A 11/2010

* cited by examiner

ELECTRICALLY-HEATED WINDOW SHEET MATERIAL

CROSS-REFERENCE TO RELATED APPLICATION

This application is a U.S. continuation application filed under 35 USC 111(a) claiming benefit under 35 USC 120 and 365(c) of PCT application JP2014/051150, filed Jan. 21, 2014, which claims priority to Application Ser. No. 2013-008783, filed in Japan on Jan. 21, 2013. The foregoing applications are hereby incorporated herein by reference.

TECHNICAL FIELD

The present invention relates to a heatable electrically-heated window sheet material including a transparent conductive film and multiple bus bars for supplying electricity to the transparent conductive film.

BACKGROUND ART

Conventionally, there is known an electrically-heated window sheet material having a transparent conductive film that is attached to a window opening part of a vehicle (see for example, Patent Document 1). Bus bars are connected to both ends of a transparent conductive film formed in the electrically-heated window sheet material. One bus bar is connected to a direct current source whereas the other bus bar is grounded. When electricity is allowed to flow through the transparent conductive film, the transparent conductive film generates heat, so that fog (water drops) or the like formed on the electrically-heated window sheet material can be removed.

PRIOR ART DOCUMENT

Patent Document

Patent Document 1: U.S. Patent Publication No. 2006/0010794

DISCLOSURE OF THE INVENTION

Problems to be Solved by the Invention

In a case where the electrically-heated window sheet material is a front glass of an automobile, various devices (e.g., electronic toll collection system (ETC), rain sensor, CCD camera, garage door opener) are placed thereon. However, these devices may not be able to function because the forming of the transparent conductive film makes it difficult for electromagnetic waves to be transmitted therethrough. In a case where the bus bars of the transparent conductive film includes an upper bus bar connected to an upper end of the transparent conductive film and a lower bus bar connected to a lower end of the transparent conductive film, recesses are formed in the upper sides of each of the transparent conductive film and the upper bus bar by shifting one part of the upper sides of the transparent conductive film and the upper bus bar more downward than the other part of the upper sides of the transparent conductive film and the upper bus bar, so as to form an electromagnetic wave transmissive window having no transparent conductive film. In this case, the vertical distance between the upper and lower bus bars is shorter in the region of the upper bus bar where the recesses are formed compared to the remaining region of the upper bus bar. Thus, the distance between the bus bars becomes different in the horizontal direction.

Therefore, electric current may concentrate at a part of the transparent conductive film where the distance between the bus bars is short. This may lead to local regions being heated to high temperature.

In view of the above-described problem, an object of an embodiment of the present invention is to provide an electrically-heated window sheet material that can improve a problem of local regions being heated to high temperature.

Means of Solving the Problems

In order to achieve the above-described object, an embodiment of the present invention provides an electrically-heated window sheet material including a heatable transparent conductive film, and multiple bus bars for supplying electricity to the transparent conductive film. The multiple bus bars include an upper bus bar connected to an upper side of the transparent conductive film, and a lower bus bar connected to a lower side of the transparent conductive film. The transparent conductive film includes a recess that is formed by shifting one part of the upper side more downward than a remaining part of the upper side or by shifting one part of the lower side more upward than a remaining part of the lower side, a band-shaped first region interposed between the upper bus bar and the lower bus bar, a band-shaped second region that is another region interposed between the upper bus bar and the lower bus bar, and multiple openings provided in the first region. The upper bus bar or the lower bus bar is formed along a side of the transparent conductive film that includes the recess. The first region is a region interposed between a bus bar at which the recess is positioned and another bus bar that faces the recess. A distance between the upper bus bar and the lower bus bar is shorter in the first region than in the second region. The multiple openings are formed in an upper part or a lower part of the first region on a side of the another bus bar facing the recess. A current flowing in the first region from one of the upper and lower bus bars to the other of the upper and lower bus bars is bypassed at least once by the openings.

EMBODIMENTS FOR CARRYING OUT THE INVENTION

Figure 1:
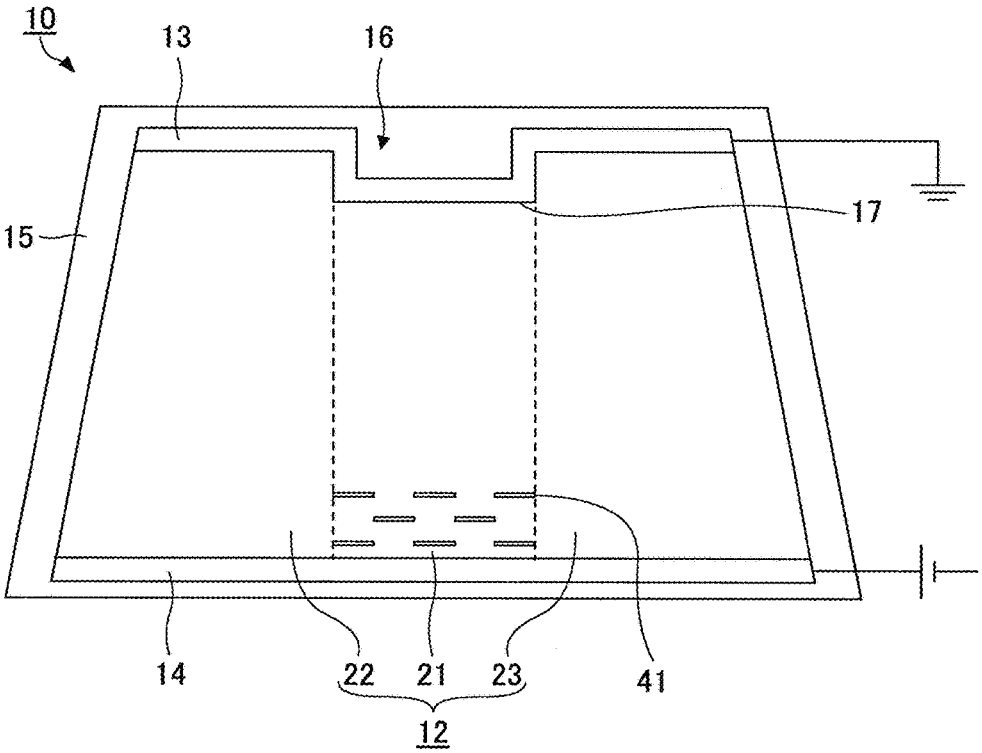
FIG. 1 is a schematic diagram illustrating an electrically-heated window sheet material according to an embodiment of the present invention.

Next, embodiments of the present invention are described with the accompanying drawings. It is to be noted that like components and parts are denoted with like reference numerals and further explanation thereof may be omitted. In describing the embodiments with the drawings, directions refers to directions in the drawings unless described as otherwise. The directions in each of the drawings correspond to the directions indicated with symbols and numerals. Further, directions such as parallel or orthogonal may deviate to the extent of not reducing the effects of the present invention. Further, each drawing is a drawing viewed from a side facing the window sheet material. Although each of the drawings illustrates an inside-vehicle view of the window sheet material in a state where the window sheet material is attached to a vehicle, the drawings may be outside-vehicle views. Upper and lower directions in each of the drawings correspond to upper and lower directions of a vehicle. A lower side of each of the drawings corresponds to a side of a road surface. Further, in a case where the window sheet material is a front glass attached to a front part of a vehicle, a horizontal direction in a drawings corresponds to a vehicle width direction of the vehicle. Further, the window sheet material is not limited to a front glass of a vehicle but may also be a rear glass attached to a rear part of the vehicle or a side glass attached to a side part of the vehicle.

Figure 2:
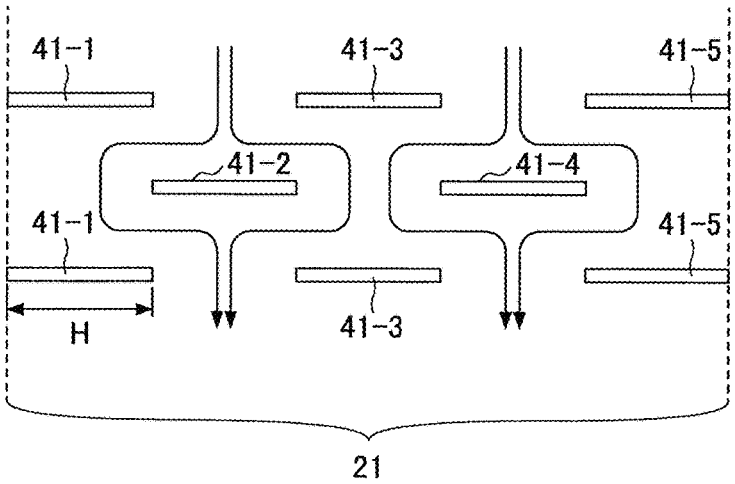
FIG. 2 is a schematic diagram illustrating an opening pattern of a transparent conductive film according to an embodiment of the present invention.

FIG. 1 is a schematic view illustrating an electrically-heated window sheet material according to an embodiment of the present invention. The broken line in FIG. 1 is an imaginary line indicating a border between a band-shaped first region and a band-shaped second region and a border between the band-shaped first region and a band-shaped third region. FIG. 2 is a schematic diagram illustrating an opening pattern of multiple openings provided in a transparent conductive film according to an embodiment of the present invention. The arrows in FIG. 2 indicate paths of electric current. The paths of electric current are illustrated for the sake of convenience and are not necessarily accurate.

An electrically-heated window sheet material 10 is attached to a window opening part of a vehicle. The electrically-heated window sheet material 10 may be, for example, attached to a window of a front part of a vehicle, that is, provided on a front side of a driver of the vehicle.

As illustrated in FIG. 1, the electrically-heated window sheet material 10 includes a substantially trapezoidal window sheet material 15, a substantially trapezoidal transparent conductive film 12 provided in the window sheet material 15, and an upper bus bar 13 and a lower bus bar 14 for supplying electric power to the transparent conductive film 12. The term "substantially trapezoidal" may refer to a shape in which an upper side is shorter than a lower side, and preferably a shape in which the length difference between the upper side and the lower side is greater than or equal to 10%. The shapes of the window sheet material 15 and the transparent conductive film 12 are not limited to substantially trapezoidal shapes but may also be shapes whose upper and lower sides are substantially the same length, rectangular shapes.

The window sheet material 15 may include multiple transparent sheets such as glass sheets that are layered interposed by a resin intermediate film. The transparent conductive film 12, the upper bus bar 13, and the lower bus bar 14 may be provided between multiple insulating transparent sheets. In this case, a conductive sheet connected to each bus bar may be extracted from an end surface of the window sheet material 15 to be used as an electrode. The upper bus bar 13 is grounded whereas the lower bus bar 14 is electrically connected to an electric power source. When electricity is supplied to the transparent conductive film 12, the transparent conductive film 12 generates heat, so that fog or the like created on the electrically-heated window sheet material 10 can be removed to ensure visibility for a driver of a vehicle.

In this embodiment, the upper bus bar 13 is grounded whereas the lower bus bar 14 is electrically connected to a power source. Alternatively, the lower bus bar 14 may be grounded whereas the upper bus bar 14 is electrically connected to a power source.

The electrically-heated window sheet material 10 may have a curved shaped projecting to the outside of a vehicle. The electrically-heated window sheet material 10 may be fabricated by bend-molding and applying heat to a transparent sheet deposited with the transparent conductive film 12. Alternatively, the electrically-heated window sheet material 10 may be fabricated by adhering a resin sheet deposited with a transparent conductive film onto a bend-molded transparent sheet.

The transparent conductive film 12 may be formed of, for example, a metal film (e.g., Ag film), a metal oxide film (e.g., ITO (Indium Tin Oxide) film), or a resin film containing fine conductive particles. The transparent conductive film 12 may be formed of layers of different kinds of region.

The transparent conductive film 12 may be formed on an insulating transparent sheet. The transparent sheet may be formed of an insulating material such as glass or resin. The glass for forming the transparent sheet may be, for example, soda-lime glass. The resin for forming the transparent sheet may be, for example, polycarbonate (PC).

A method for depositing the transparent conductive film 12 may be, for example, a dry-coating method. The dry-coating method may be, for example, a PVD method or a CVD method. Among the PVD methods, a vacuum evaporation method, a sputtering method, or an ion-plating method is preferable. Among these methods, the sputtering method capable of depositing a large region is preferable.

In this embodiment, the dry-coating method is used as the method for depositing the transparent conductive film 12. Alternatively, a wet-coating method may be used.

The upper bus bar 13 is connected to an upper edge of the transparent conductive film 12 and the lower bus bar 14 is connected to a lower edge of the transparent conductive film 12. The upper bus bar 13 and the lower bus bar 14 are provided having the transparent conductive film 12 interposed therebetween for supplying electric power to the transparent conductive film 12.

The electrically-heated window sheet material 10 includes a recess 17 formed by shifting one part of the transparent conductive film 12 and one part of the upper bus bar 13 more downward compared to other parts of the transparent conductive film 12 and other parts of the upper bus bar 13. An electromagnetic wave transmitting window 16 is formed in the recess 17 that is formed without the transparent conductive film. Various devices may be placed at the electromagnetic wave transmitting window 16 as a position for communicating with the outside of the vehicle. The upper bus bar 13 is formed along the upper side of the upper side of the transparent conductive film 12 including the recess 17. Compared to the other regions of the upper bus bar 13, the vertical distance between the upper bus bar 13 and the lower bus bar 14 is shorter at a part of the upper bus bar 13 at which the electromagnetic wave transmitting window 16 is formed. Although the electromagnetic wave transmitting window 16 of this embodiment is formed in the upper side of the transparent conductive film 12, the electromagnetic wave transmitting window 16 may be formed in the lower side of the transparent conductive film 12. In this case, a recess is formed by shifting a part of the transparent conductive film 12 and a part of the lower bus bar more upward compared to the other parts of the transparent conductive film 12 and the other parts of the lower bus bar.

Next, an opening pattern having multiple openings provided in the transparent conductive film 12 is described with reference to FIGS. 1 and 2. The term "vertical" refers to a direction that is substantially orthogonal to the upper side of the transparent conductive film 12, and the term "horizontal" refers to a direction that is orthogonal to the vertical direction. The vertical direction and the horizontal direction are directions that are substantially parallel to the surface of the transparent conductive film 12 and that are alongside the surface of the transparent conductive film 12.

As illustrated in FIG. 1, the transparent conductive film 12 includes first to third regions 21-23 interposed between the upper bus bar 13 and the lower bus bar 14. The first region 21 is interposed between the second region 22 and the third region 23. The distance between the upper bus bar 13 and the lower bus bar 14 in the first region 21 is shorter compared to those of the second and third regions 22, 23. The first region 21 may be a band-shaped region interposed between a bus bar having the recess provided on the upper or lower side of the transparent conductive film 12 and a bus bar facing the recess.

Because the first, second, and third regions 21, 22, 23 are adjacent to each other, electric power is simultaneously supplied from a single upper bus bar 13 and a single lower bus bar 14, and substantially the same voltage is applied across the first to third regions 21, 22, 23 from the left side to the right side. Electric current flows in each of the first, second, and third regions 21 to 23.

Multiple openings 41 having horizontal dimensions H (see FIG. 2) greater than or equal to predetermined values are provided in the first region 21 for adjusting surface resistance. The multiple openings 41 may have the same shapes and same dimensions. The openings 41 are formed by using laser processing or the like and penetrating the transparent conductive film 12 in the thickness direction. The openings 41 may be diagonally elongated. Further, the openings 41 may be diagonally elongated and have horizontal dimensions H greater than or equal to predetermined values. The multiple openings 41 may have different shapes and different dimensions.

The horizontal dimension H is sufficient as long as an electric current path is extended so that the electric current flowing in the first region 21 from one of the upper and lower bus bars 13, 14 to the other of the upper and lower bus bars 13, 14 can bypass the openings 41 in the horizontal direction. That is, the horizontal dimension H is sufficient as long as the length of the path for bypassing the electric current path of the electric current flowing in the first region 21 is set close to the length of the electric current path of the electric current flowing in the second and third regions 22 and 23. Although the horizontal dimension H may be discretionally set according to the path length of the electric current flowing in the second and third regions 22, 23, it is preferable to be, for example, greater than or equal to 20 mm, more preferably greater than or equal to 25 mm, and yet more preferably greater than or equal to 30 mm and less than or equal to 100 mm.

The multiple horizontally elongated openings 41 are preferred not to be formed in a center part of the first region 21 in the vertical direction, so that the visibility of the driver of a vehicle is prevented from being obstructed. Thus, the horizontally elongated openings 41 are formed in a lower part of the first region 21 as illustrated in FIG. 1. For example, multiple horizontally elongated openings 41 are formed in a region no greater than 400 mm upward from the lower side of the transparent conductive film 12, and preferably no greater than 300 mm, and more preferably no greater than 200 mm. The multiple horizontally elongated openings 41 may be formed in a part of the first region 21 that is close to the bus bar facing the recess 17 relative to the recess 17 formed in the upper or lower side of the transparent conductive film 12.

As illustrated in FIG. 2, the horizontally elongated openings 41 may be arranged without any spaces in-between when viewed in the vertical direction. When viewed from the vertical direction, the multiple horizontally elongated openings 41 may contact or overlap with each other. In any case, the openings 41 can prevent the current flowing in the first region 21 from vertically advancing at a shortest distance from one of the upper bus bar 13 and the lower bus bar 14 to the other of the upper bus bar 13 and the lower bus bar 14, and allow the electric current path to be bypassed.

The horizontally elongated openings 41 may be arranged so that the current flowing in the first region 21 bypasses the openings 41 either rightward or leftward one or more times. The path of the current flowing in the first region 21 becomes longer and the difference with the path of the current flowing in the second or third region 22, 23 becomes smaller. Therefore, the first region 21, the second region 22, and the third region 23 can be heated to the same degree. The term "bypass" means that electric current shifts leftward or rightward. The electric current may shift rightward after shifting leftward or shift leftward after shifting rightward. The "bypassing of the electric current one or more times" refers to the electric current shifting leftward or rightward at least once. The number of times of shifting leftward and the number of times shifting rightward may be the same or different.

The horizontally elongated openings 41 may also be formed in the second region 22 and the third region 33 as long the horizontally elongated openings 41 are formed in the first region 21. For example, the horizontally elongated openings 41 may be provided throughout the transparent conductive film 12 in the horizontal direction. In this case, the electric current path may become longer in all of the regions. However, compared to a case where no horizontally elongated openings 41 are formed in the transparent conductive film 12, the difference in the length of the electric current path of the first region 21 and that of the second or third region 22, 23 becomes smaller in terms of proportion even though the same in terms of absolute value. Therefore, concentration of electric current due to the differences in the lengths of the electric current paths can be reduced. Thus, the problem of local regions being heated to high temperatures can be improved.

In a case where the openings 41 are formed in the upper part of the first region 21 toward the recess 17, electric current that bypass the openings 41 may merge with the electric current that flows in the vicinity of the recess 17 and tends to gather at the upper part of the first region 21. Therefore, electric current may concentrate at this region and lead to local regions being heated to high temperature.

Figure 10:
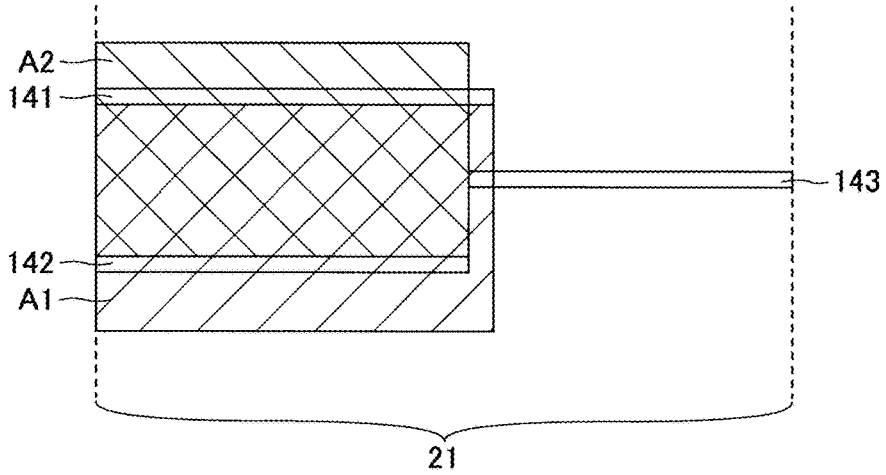
FIG. 10 is a schematic diagram for describing a positional relationship of openings.

Next, the arrangement of the openings that bypass the electric current path is described with reference to FIG. 10. The first region 21 of FIG. 10 includes a first opening 141, a second opening 142, and a third opening 143. The first opening 141 and the second opening 142 are arranged to be spaced apart from each other in the vertical direction. Further, the third opening 143 partly overlaps with an extended region A1 (region indicated with diagonal lines slanted toward the lower left in FIG. 10) that extends from the first opening 141 to the second opening 142 in the vertical direction. Therefore, first, the path of the electric current flowing from top to bottom toward the first opening 141 in the first region 21 is blocked by the first opening 141 and shifts rightward. Then, the path of the electric current is blocked by the third opening 143 and shifts leftward. Further, the third opening 143 contacts an extended region A2 (region indicated with diagonal lines slanted toward the lower right in FIG. 18) that extends from the second opening 142 to the first opening 141 in the horizontal direction. Therefore, after the path of the electric current is blocked by the third openings 143 and shifts leftward, the path of the electric current is blocked by the second opening 142 and shifts rightward. Therefore, the path of the electric current flowing in the first region 21 vertically bypasses the first opening 141, the second opening 142, and the third opening 143 at least once.

The openings that bypass the electric current path may be arranged in various ways. For example, another opening(s) may be provided between the first opening 141 and the second opening 142 arranged adjacent to each other in the vertical direction. Further, the third opening 143 may contact the extended region A1 and partly overlap with the extended region A2. The third opening 143 extends in a direction separating from both the extended region A1 and the extended region A2.

Next, the arrangement of the openings that bypass the electric current path is described with reference to FIG. 2. The first region 21 illustrated in FIG. 2 includes first, second, and third openings 41-1, 41-2 that form a first row. The left end of the third opening 41-2 contacts a region extending from the first opening 41-1 to the second opening 41-1 in the vertical direction and a region extending from the second opening 41-1 to the second opening 41-1 in the vertical direction, respectively. First, the path of the electric current flowing in the vertical direction to the first opening 41-1 of the first row is blocked by the opening 41-1 of the first row and shifts rightward. Then, the path of the electric current is blocked by the third opening 41-2 and shifts leftward. Further, the path of the electric current flowing in the vertical direction to the third opening 41-2 is blocked by the third opening 41-2 and shifts leftward. Then, the path of the electric current is blocked by the opening 41-1 of the first row and shifts rightward. Therefore, the path of the electric current flowing in the first region 21 is horizontally bypassed at least once by the first opening 41-1, the second opening 41-1, and the third opening 41-2.

As illustrated in FIG. 2, the multiple openings 41 include a row (first row) having openings 41-1 arranged in the vertical direction and a single opening 41-2 arranged at positions shifted vertically and horizontally from the openings 41-1 of the first row.

The positions being shifted vertically and horizontally from the openings refers to shifting positions from the openings, serving as the benchmark, in the direction in which electric current flows between the bus bars, that is, the vertical direction, and further, in the direction orthogonal to the direction in which electric current flows, that is, the horizontal direction. For example, the positions shifted in vertical and horizontal directions from each of the openings 41-1 of the first row include a position shifted in the horizontal direction from the space between two openings 41-1 of the first row. In a case where there is only a single opening in a target row, the positions shifted in vertical and horizontal directions include a position shifted in a vertical direction from regions contacting both horizontal ends of the single opening. The openings 41-1 of the first row and the openings 41-2 may be arranged, so that the current flowing between the bus bars horizontally staggers by bypassing each of the openings 41. The path of the electric current flowing in the first region 21 easily becomes long. The openings 41-2 may be arranged in positions shifted vertically and horizontally from the openings 41-1 of the first row and arranged at spaced-intervals in the vertical direction to form a row (second row).

The multiple openings 41 may include openings 41-3 arranged in positions shifted vertically and horizontally from the openings 41-2 and arranged at spaced-intervals in the vertical direction to form a row (third row). The multiple openings 41 may include a single opening 41-4 arranged in a position shifted vertically and horizontally from the openings 41-3 of the third row. The multiple openings 41-4 may be arranged in positions shifted vertically and horizontally from the openings 41-3 of the third row and arranged at spaced-intervals in the vertical direction to form a row (fourth row). Further, the multiple openings 41 may include multiple openings 41-5 arranged in positions shifted vertically and horizontally from the openings 41-4 and arranged in the vertical direction to form a row (fifth row).

In the first region 21, openings 41 having horizontal dimensions H greater than or equal to predetermined values may be arranged in a staggered manner in the vertical direction as illustrated in FIG. 2. The intervals of the change of electric current becomes shorter and the path of the electric current easily becomes long.

In a case where the transparent conductive film 12 is provided in the window sheet material 15 as in this embodiment, electromagnetic waves are blocked by the second region 22 and the third region 23 of the transparent conductive film 12. That is, because the second and third regions 22, 23 prevent electromagnetic waves from transmitting through a vehicle, the electromagnetic waves of devices required to communicate with the outside of the vehicle are blocked.

However, with the first region 21 of this embodiment, electromagnetic waves of a predetermined frequency can be transmitted by providing horizontally elongated openings 41 as illustrated in FIG. 2. More specifically, an electromagnetic wave of a predetermined frequency having a vertically polarized wave plane and corresponding to the length of the horizontal dimension H is can be transmitted, and the first region 21 can function as a frequency selective surface.

In this embodiment, it is preferable that the horizontal dimension H of the opening 41 is greater than or equal to "$(1/2)\cdot\lambda_g$" in a case where the atmospheric wavelength of a center frequency of a predetermined frequency band of a vertically polarized electromagnetic wave to be transmitted is "$\lambda_0$", "k" is a shortening coefficient of wavelength by the electrically-heated window sheet material 10, and the wavelength of the electrically-heated window sheet material 10 is "$\lambda_g=\lambda_0\cdot k$". In a case where the electrically-heated window sheet material 10 is a laminated glass having two glass sheets laminated interposed by an intermediate film formed of polyvinyl butyral, the shortening coefficient of wavelength "k" is approximately 0.51. For example, in a case where the predetermined frequency desired to be transmitted is 900 MHz, it is preferable that the horizontal dimension H is greater than or equal to 85 mm. Further, in a case where the predetermined frequency desired to be transmitted is 1.9 GHz, it is preferable that the horizontal dimension H is greater than or equal to 40 mm.

Figure 3:
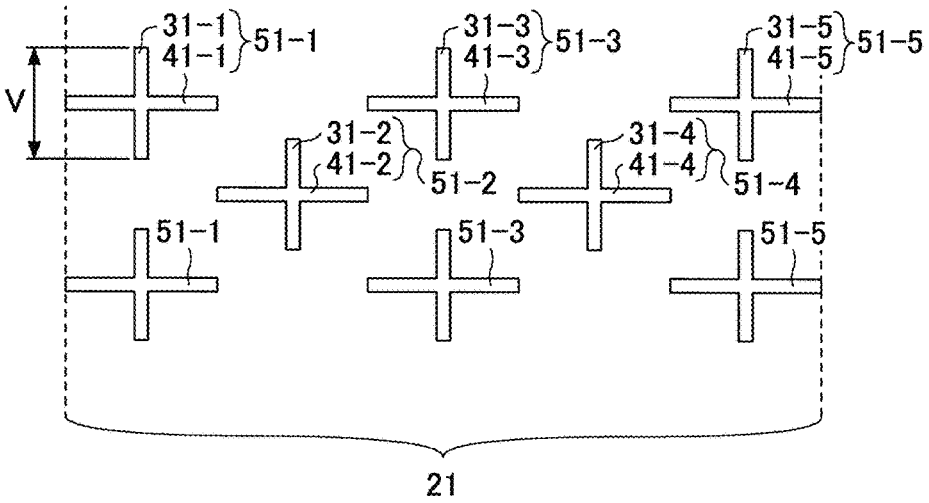
FIG. 3 is a schematic diagram illustrating an opening pattern of a transparent conductive film according to a first modified example.

Next, an opening pattern of multiple openings of a transparent conductive film according to a first modified example is described with reference to FIG. 3. Similar to the above-described embodiment, the modified example also has multiple horizontally elongated openings 41 having the same shapes and dimensions arranged in the first region 21 in a staggered manner in the vertical direction.

Unlike the above-described embodiment, this modified example has vertical openings 31 having vertical dimensions V greater than or equal to predetermined dimensions in the first region 21. The vertical openings 31 may be elongated in a vertical direction and have linear shapes. Because the first region 21 of the above-described embodiment has horizontally elongated openings 41, the first region 21 may be a frequency selective surface that allows vertically polarized electromagnetic waves to be transmitted as described above. The first region 21 of this modified example not only has horizontally elongated openings 41 but also has vertically elongated vertical openings 31. Thus, the first region 21 allows horizontally polarized electromagnetic waves of a predetermined frequency to be transmitted, so that the first region 21 functions as a frequency selective surface that allows horizontally polarized electromagnetic waves to be transmitted.

In this case, it is preferable that the vertical dimension V of the vertical opening 31 is greater than or equal to "$(1/2)\cdot\lambda_{g1}$" in a case where the atmospheric wavelength of a center frequency of a predetermined frequency band of a horizontally polarized electromagnetic wave to be transmitted is "$\lambda_{01}$", "k" is a shortening coefficient of wavelength by the electrically-heated window sheet material 10, and the wavelength of the electrically-heated window sheet material 10 is "$\lambda_{g1}=\lambda_{01}\cdot k$". For example, in a case where the predetermined frequency desired to be transmitted is 2.4 GHz, it is preferable that the vertical dimension V is greater than or equal to 32 mm when the wavelength shrinkage rate is 0.51.

The multiple vertically elongated vertical openings 31-1~31-5 have the same shapes and dimensions and are arranged in the first region 21 in a staggered manner in the vertical direction.

Further, multiple cross openings 51 having the horizontally elongated openings 41 and the vertically elongated vertical openings 31 intersecting in a cross are arranged in the first region 21 of this modified example. As illustrated in FIG. 3, the multiple cross openings 51 include a row (first row) having cross openings 51-1 arranged in the vertical direction and a single cross opening 51-2 arranged in a position vertically and horizontally shifted from the cross openings 51-1 of the first row. The cross openings 51-2 may be arranged in positions vertically and horizontally shifted from the cross-openings 51-1 of the first row and arranged at spaced-intervals in the vertical direction to form a row (second row). Further, the multiple cross openings 51 may also include cross openings 51-3 arranged in the vertical direction (third row) and arranged in positions shifted vertically and horizontally from a single cross opening 51-2. Further, the multiple cross openings 51 may also include a single cross openings 51-4 arranged in a position shifted vertically and horizontally from the cross openings 51-3 of the third row. The cross openings 51-4 may be arranged in positions vertically and horizontally shifted from the cross openings 51-3 of the third row and arranged at spaced-intervals in the vertical direction to form a row (fourth row). Further, the multiple cross openings 51 may include multiple cross openings 51-5 arranged in positions vertically and horizontally shifted from one cross opening 51-4 and arranged in the vertical direction to form a row (fifth row). Because the cross openings 51 having the same shapes and dimensions are arranged in a staggered manner, the cross openings 51 are pleasant to the eye.

Figure 4:
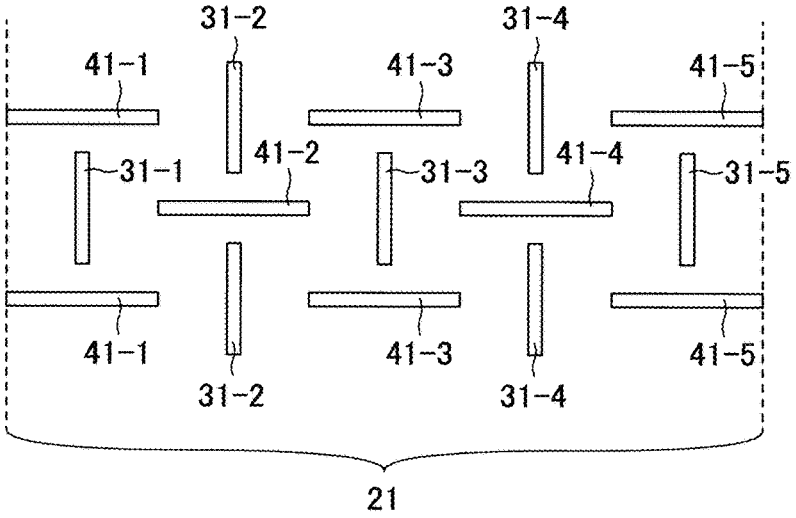
FIG. 4 is a schematic diagram illustrating an opening pattern of a transparent conductive film according to a second modified example.

Next, an opening pattern of multiple openings of a transparent conductive film according to a second modified example is described with reference to FIG. 4. Similar to the first modified example, the second modified example also has multiple horizontally elongated openings 41 having the same shapes and dimensions and arranged in the first region 21 in a staggered manner in the vertical direction. The multiple openings 41-1 that are arranged in the vertical direction form a first row, the multiple openings 41-3 that are arranged in the vertical direction form a third row, and the multiple openings 41-5 that are arranged in the vertical direction form a fifth row. A single opening 41-2 is arranged between the first row and the third row. A single opening 41-4 is arranged between the third row and the fifth row. The opening 41-2 and the opening 41-4 may be multiply formed at spaced-intervals in the vertical direction to form the second and fourth rows. Further, multiple vertically elongated vertical openings 31 have the same shapes and dimensions and are arranged in a staggered manner in the vertical direction. The vertical openings 31-1 may be interposed between each of the openings 41-1 of the first row, the vertical openings 31-3 may be interposed between each of the openings 41-3 of the third row, and the vertical openings 31-5 may be interposed between each of the openings 41-5 of the fifth row. Further, the openings 41-2 of the second row may be provided between two vertical openings 31-2 that are arranged at spaced-intervals in the vertical direction, and the openings 41-4 of the fourth row may be provided between two vertical openings 31-4 arranged at spaced-intervals in the vertical direction.

Unlike the first modified example, the horizontally elongated openings 41-1~41-5 and the vertically elongated vertical openings 31-1~31-5 of this modified example are spaced apart from each other and do not intersect. However, because this modified example is provided with vertical openings 31 having vertical dimensions greater than or equal to predetermined values, electromagnetic waves having horizontally polarized waves of a predetermined frequency are allowed to be transmitted similar to those of the first modified example, so that the first region 21 functions as a frequency selective surface that allows horizontally polarized electromagnetic waves to be transmitted. Because horizontally elongated openings 41 having the same shapes and dimensions and vertically elongated vertical openings 31 having the same shapes and dimensions are orderly arranged, the horizontally elongated openings 41 and the vertical openings 31 are pleasant to the eye.

Figure 5:
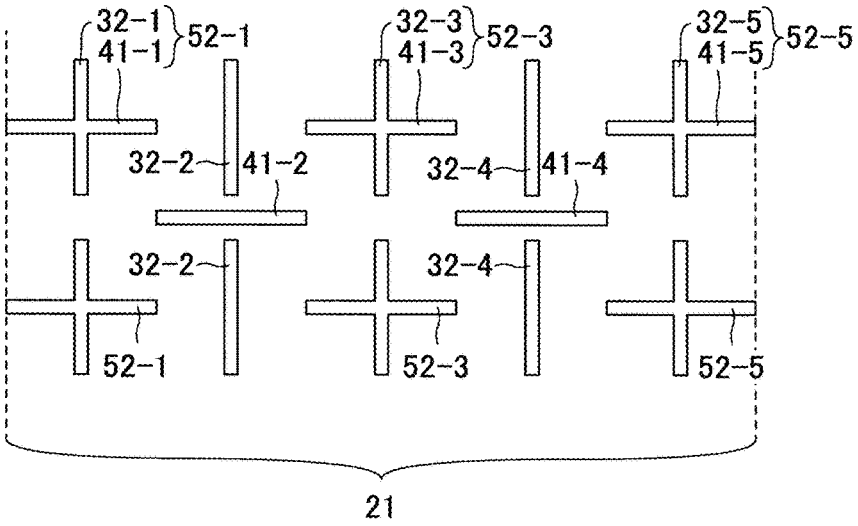
FIG. 5 is a schematic diagram illustrating an opening pattern of a transparent conductive film according to a third modified example.

Next, an opening pattern of multiple openings of a transparent conductive film according to a third modified example is described with reference to FIG. 5. Similar to the first modified example, this modified example has multiple horizontally elongated openings 41 having the same shapes and dimensions and being arranged in the first region 21 in a staggered manner in the vertical direction. The multiple openings 41-1 that are arranged in the vertical direction form a first row, the multiple openings 41-3 that are arranged in the vertical direction form a third row, and the multiple openings 41-5 that are arranged in the vertical direction form a fifth row. A single opening 41-2 is provided between the first row and the third row, and a single opening 41-4 is provided between the third row and the fifth row. The openings 41-2 and the openings 41-4 may be arranged at spaced-intervals in the vertical direction to form second and fourth rows, respectively. Further, the vertical openings 32 having vertical dimensions greater than or equal to predetermined values are provided in the first region. The vertical openings 32 may be elongated in the vertical direction and have linear shapes. The multiple vertically elongated vertical openings 32 have the same shapes and dimensions.

Unlike the first modified example, this modified example has multiple vertically elongated vertical openings 32 arranged in vertical and horizontal directions. Among the multiple vertically elongated vertical openings 32, portions thereof 32-1, 32-3, 32-5 intersect the horizontally elongated openings 41 in a cross-like manner whereas remaining portions thereof 32-2, 32-4 are spaced apart from the horizontally elongated openings 41. That is, the openings 41-1 of the first row and the openings 41-3 of the third row, and the openings 41-5 of the fifth row form cross openings 52-1, 52-3, 52-5 by intersecting the vertical openings 32 whereas the openings 41-2 of the second row and the openings 41-4 of the fourth row are spaced apart from the vertical openings 32-2, 32-4. By forming the first region 21 in this manner, this modified example can attain the same effects as those attained by the first and second modified examples.

Figure 6:
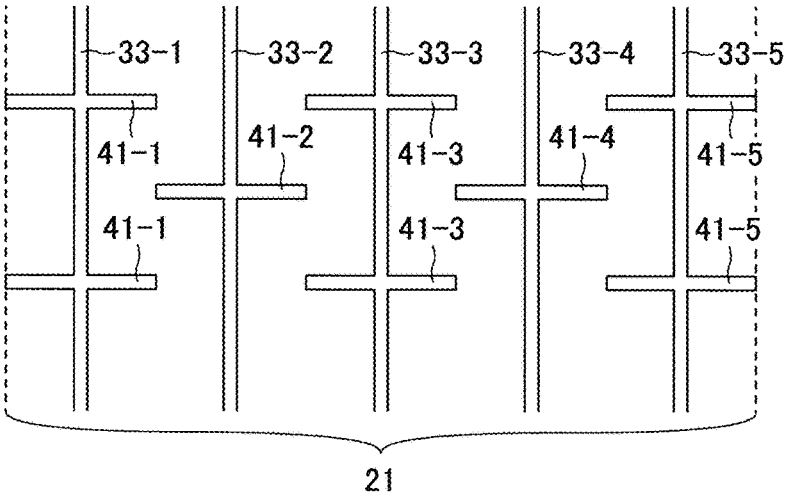
FIG. 6 is a schematic diagram illustrating an opening pattern of a transparent conductive film according to a fourth modified example.

Next, an opening pattern of multiple openings of a transparent conductive film according to a fourth modified example is described with reference to FIG. 6. Similar to the first modified example, this modified example has multiple horizontally elongated openings 41-1~41-5 having the same shapes and dimensions and arranged in the first region 21 in a staggered manner in the vertical direction. The multiple openings 41-1 that are arranged in the vertical direction form a first row, the multiple openings 41-3 that are arranged in the vertical direction form a third row, and the multiple openings 41-5 that are arranged in the vertical direction form a fifth row. A single opening 41-2 is provided between the first row and the third row, and a single opening 41-4 is provided between the third row and the fifth row. Multiple openings 41-2 and multiple openings 41-4 may be arranged at spaced-intervals in the vertical direction to form second and fourth rows, respectively. Further, vertical openings 33-1~33-5 having vertical dimensions greater than or equal to predetermined values are provided in the first region 21. The vertical openings 33-1~33-5 may be elongated in the vertical direction and have linear shapes. By providing the vertically elongated vertical openings 33, electromagnetic waves having horizontally polarized waves of a predetermined frequency can be transmitted, so that the first region 21 functions as a frequency selective surface that allows horizontally polarized electromagnetic waves to be transmitted. The multiple vertically elongated vertical openings 33 have the same shapes and dimensions.

Unlike the first modified example, this modified example has vertically elongated vertical openings 33 each of which intersecting multiple horizontally elongated openings 41 arranged at spaced-intervals in the vertical direction. By providing the vertical openings 33 having sufficiently long vertical dimensions, the frequency range of horizontally polarized electromagnetic waves that are to be transmitted can be broadened.

Figure 7:
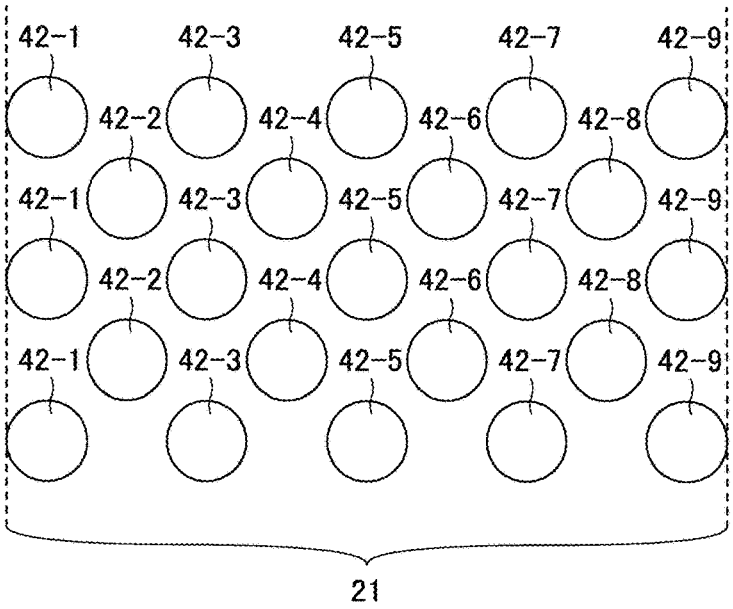
FIG. 7 is a schematic diagram illustrating an opening pattern of a transparent conductive film according to a fifth modified example.

Next, an opening pattern of a transparent conductive film according to a fifth modified example is described with reference to FIG. 7. Similar to the above-described embodiment, the openings 42 of this modified having horizontal dimensions greater than or equal to predetermined values are formed in the first region 21. The multiple openings 42-1 that are arranged in the vertical direction may form a first row. The multiple openings 42-2 being arranged in positions shifted vertically and horizontally from each opening 42-1 of the first row and being arranged in the vertical direction may form a second row. The multiple openings 42-3 being arranged in positions shifted vertically and horizontally from each opening 42-2 of the second row and being arranged in the vertical direction may form a third row. In a similar manner, the openings 42-4~42-9 may form fourth to ninth rows.

Unlike the above-described embodiment, the openings 42 of this modified example having horizontal dimensions greater than or equal to predetermined values do not have linear shapes but have circular shapes. The vertical dimensions of the circular openings 42 and the horizontal dimensions of the circular openings 42 are the same. Although the shapes of the openings 42 of this modified example are circular, the shapes of the openings 42 may be elliptical shapes or polygonal shapes such as square shapes or rectangular shapes. By forming the multiple openings having vertical dimensions greater than or equal to predetermined values and vertical dimensions greater than or equal to predetermined values, this modified example can attain the same effects as those attained by the first modified example.

Practical Example

First to Second Samples

In the first to second samples, electromagnetic field simulation using a FDTD (Finite Difference Time Domain) method is performed to analyze the transmission property of vertically polarized electromagnetic waves with respect to laminated glass having transparent conductive film.

With the first to second samples, the analysis is performed under the same conditions except for changing the opening patterns of the multiple openings of the transparent conductive film. The laminated glass includes a glass sheet, an intermediate film, a transparent conductive film, an intermediate film, and a glass sheet in this order. The vertically polarized wave is incident on the laminated glass in its thickness direction. Among the four sides of the transparent conductive film having a rectangular shape (width 300 mm×height 200 mm), a magnetic wall is set as a boundary condition for the upper and lower sides and an electric wall is set as a boundary condition for the left and right sides. The frequency of the electromagnetic wave that is to be transmitted is changed from 0 GHz to 3 GHz.

The model of the laminated glass in the electromagnetic simulation is set as follows.

Thickness of each glass sheet: 2.0 mm
Thickness of each intermediate film: 0.381 mm
Thickness of transparent conductive film: 0.01 mm
Relative permittivity of each glass sheet: 7.0
Relative permittivity of each intermediate film: 3.0
Resistance of transparent conductive film: 1.0 Ω

Figure 8:
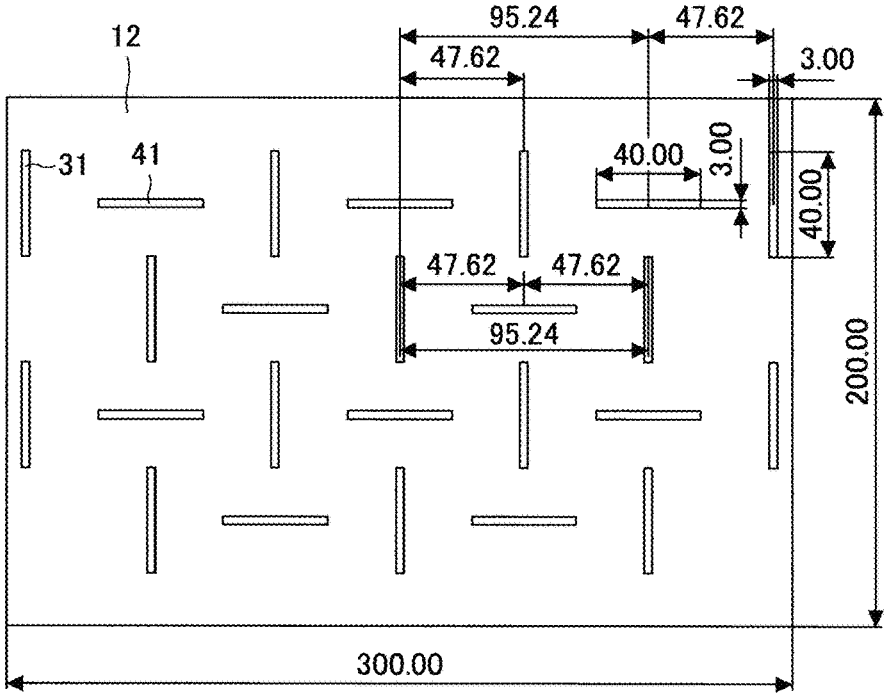
FIG. 8 is a schematic diagram illustrating an opening pattern of a transparent conductive film according to a sixth modified example.

FIG. 8 is a schematic diagram illustrating an opening pattern of multiple openings of a transparent conductive film according to the first sample. In FIG. 8, reference numeral 12 indicates a transparent conductive film, reference numeral 41 indicates a horizontally elongated opening, reference numeral 31 indicates a vertically elongated opening, and the other numerals indicate the dimensions of the opening pattern (mm). Because the opening pattern of the first sample is similar to the opening pattern of the second modified example (see FIG. 4), further description thereof is omitted.

The second sample is a comparative example using a transparent conductive film without any openings. Thus, an illustration thereof is omitted.

Figure 9:
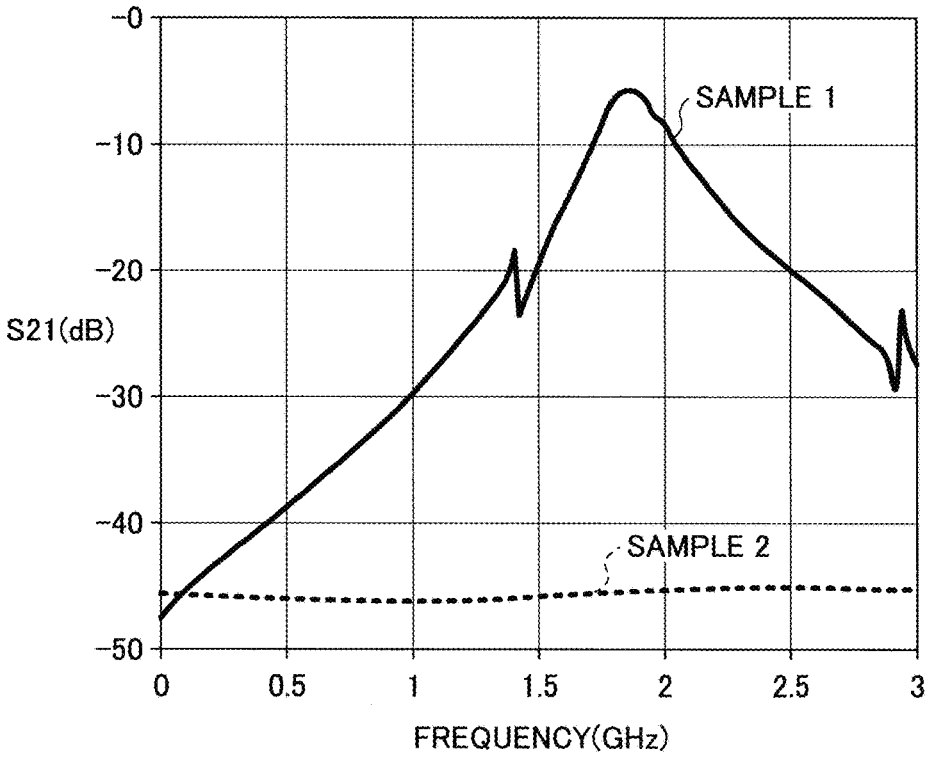
FIG. 9 is a graph illustrating a transmission property of electromagnetic waves according to the first and second samples.

FIG. 9 is a graph illustrating transmission property of a vertically polarized wave with respect to laminated glass including the transparent conductive film of the first to second samples. In FIG. 9, the solid line indicates an analysis result of the first sample and a broken line indicates an analysis result of the second example. The vertical axis of FIG. 9 corresponds to a frequency (GHz) of a vertically polarized wave that is to be transmitted, and the horizontal axis of FIG. 9 corresponds to transmission loss S21 (dB) of the incident vertically polarized wave.

As shown in FIG. 9, it can be understood that the first sample allows vertically polarized waves to be transmitted through the transparent conductive film more easily compared to the second sample because vertically elongated openings are provided. Although the transmission property of the vertically polarized wave is described above, the results regarding the transmission property of the horizontally polarized wave are also the same because the horizontal dimensions of the openings and the vertical dimensions of the openings are the same and the openings are arranged at equally spaced-intervals.

Third to Sixth Samples

In the third to sixth samples, heat generation simulation is performed to analyze the temperature distribution when voltage is applied to laminated glass. The third sample is a practical example whereas the fourth to sixth samples are comparative examples.

For simplifying the analysis, the laminated glass includes a glass sheet, a transparent conductive film, and a glass sheet in this order and does not include an intermediate film. The dimensions and physical characteristics of each of the elements are as follows.

Thickness of each glass sheet: 2.0 mm
Thermal conductivity of each glass sheet: 1.0 W/(m·K)
Specific heat of each glass sheet: 670 J/(kg·K)
Mass density of each glass sheet: 2.2 g/cm$^3$
Thickness of transparent conductive film: 0.002 mm
Electric conductivity of transparent conductive film: 625000 $\Omega^{-1}\cdot m^{-1}$
Thermal conductivity of transparent conductive film: 420 W/(m·K)
Specific heat of transparent conductive film: 235 J/(kg·K)
Mass density of each transparent conductive film: 1.07 g/cm$^3$ The finite-element analysis model of the laminated glass is fabricated by using software "HyperMesh" manufactured by Altair Engineering Ltd. The temperature distribution of the model when voltage is applied between the bus bars is obtained by using software "Abaqus/Standard" which is a general-purpose finite-element analysis program manufactured by Dassault Systems Corp.

The initial temperature of the laminated glass is 23° C., and a heat transfer boundary condition is set to a boundary between the laminated glass and the air. The heat transfer boundary condition refers to a boundary condition in which heat transfer is performed between the laminated glass and the air. The heat transfer coefficient between the laminated glass and the air is 8.0 W/m$^2$·K, and the temperature of the air is constantly 23° C. The voltage between the bus bars is 12 V.

Figure 11:
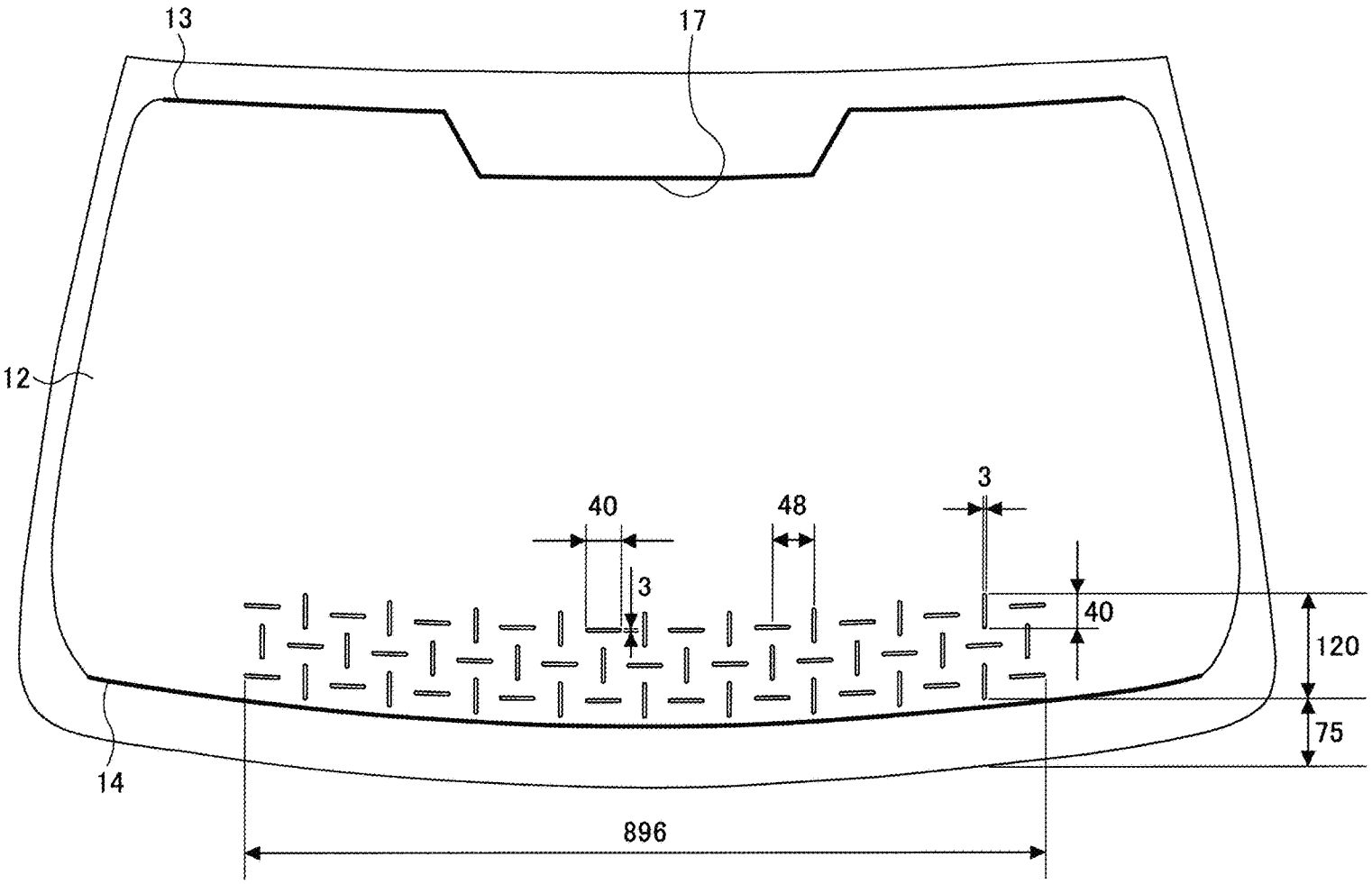
FIG. 11 is a schematic diagram illustrating the dimension and shape of laminated glass according to a third sample.
Figure 12:
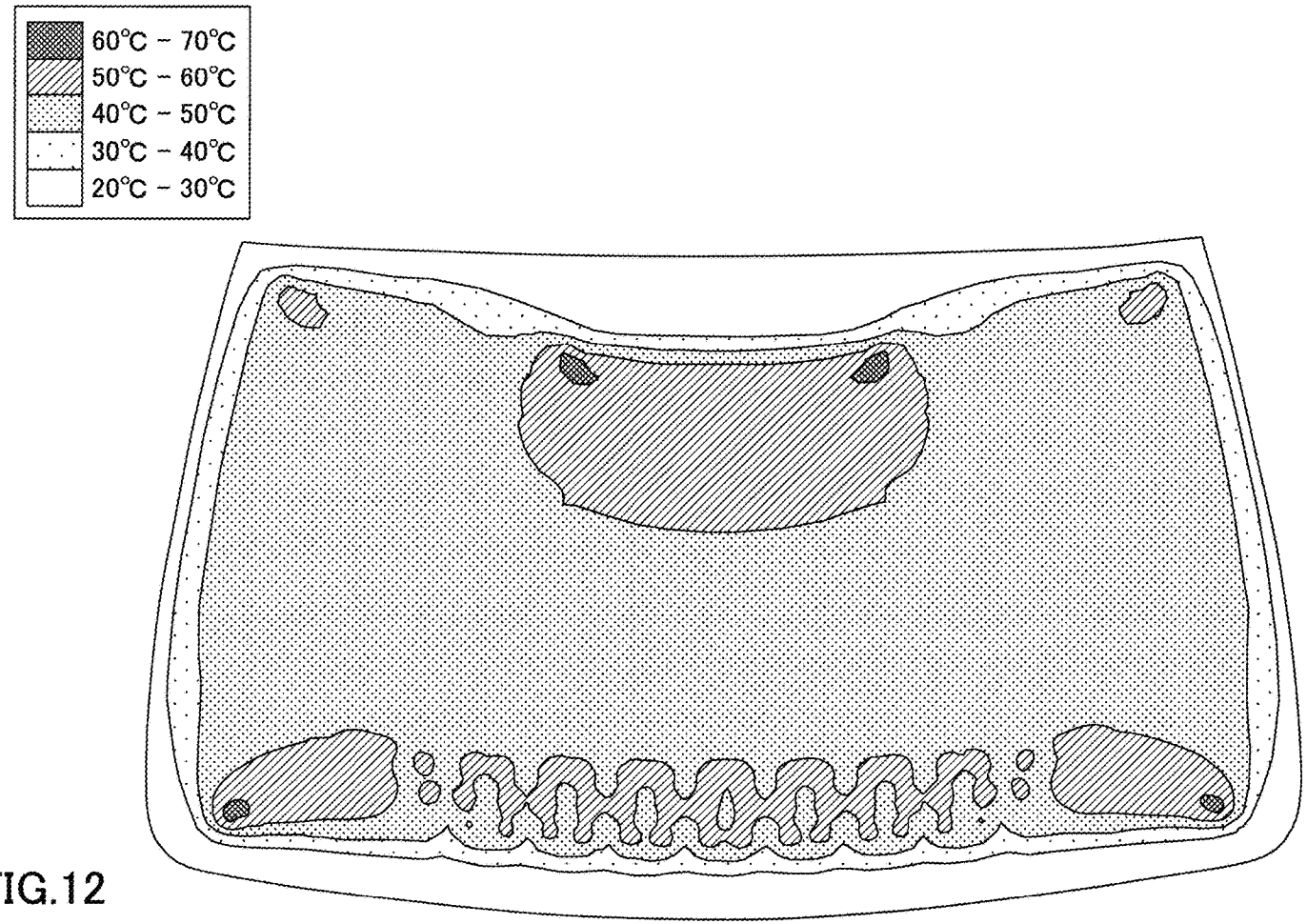
FIG. 12 is a schematic diagram illustrating temperature distribution of laminated glass according to the third sample when voltage is applied.
Figure 13:
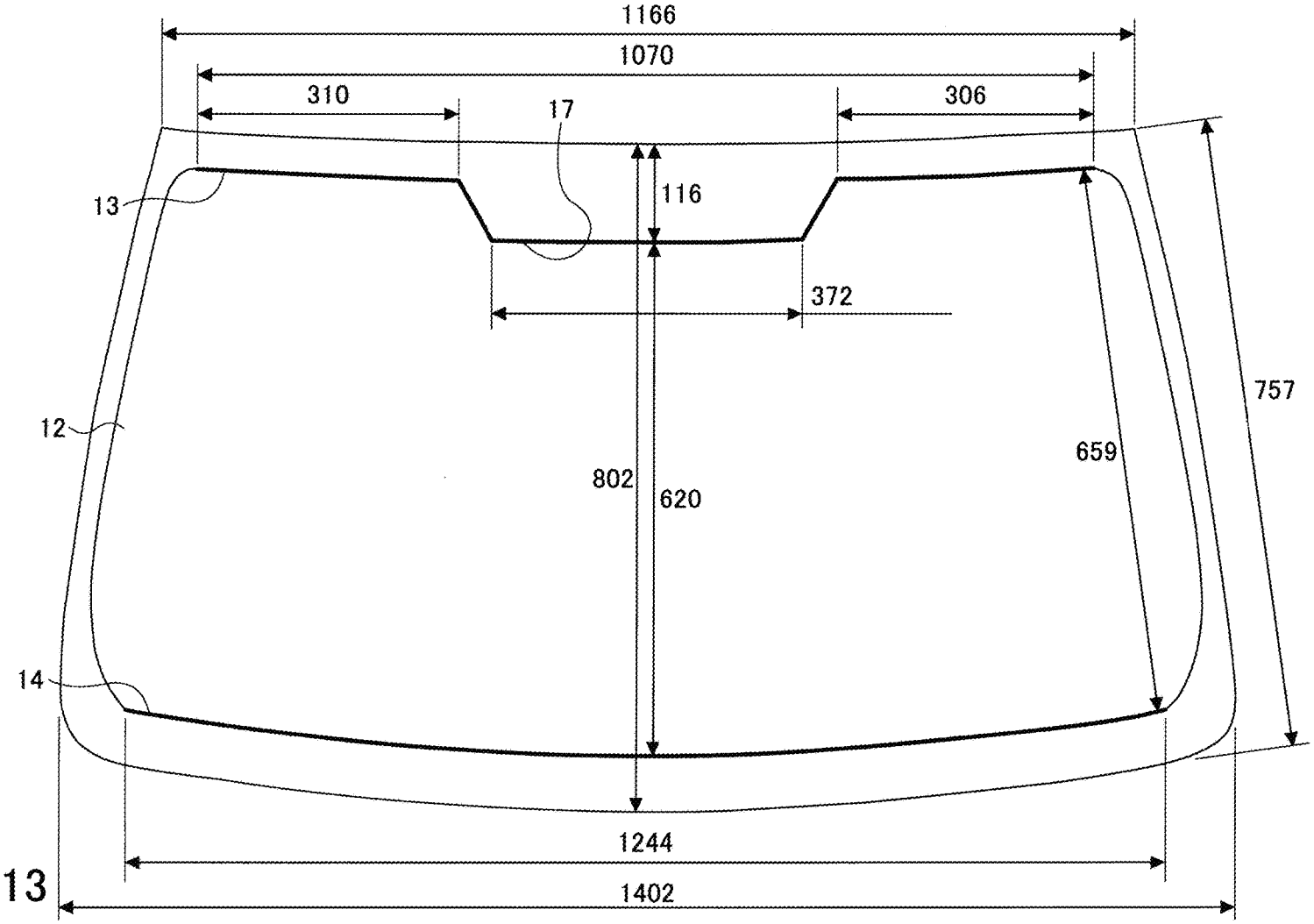
FIG. 13 is a schematic diagram illustrating the dimension and shape of laminated glass according to a fourth sample.
Figure 14:
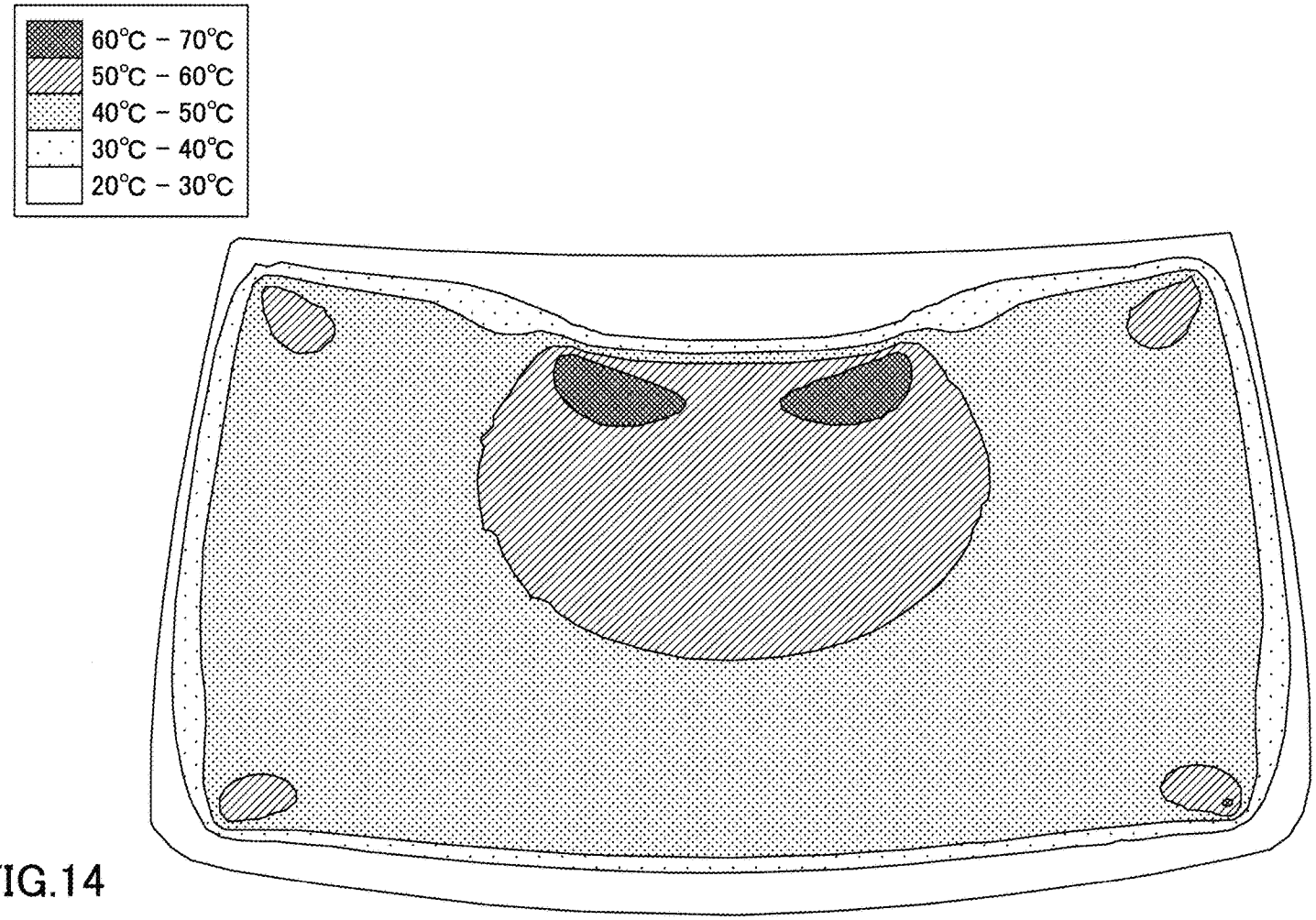
FIG. 14 is a schematic diagram illustrating temperature distribution of laminated glass according to the fourth sample when voltage is applied.
Figure 15:
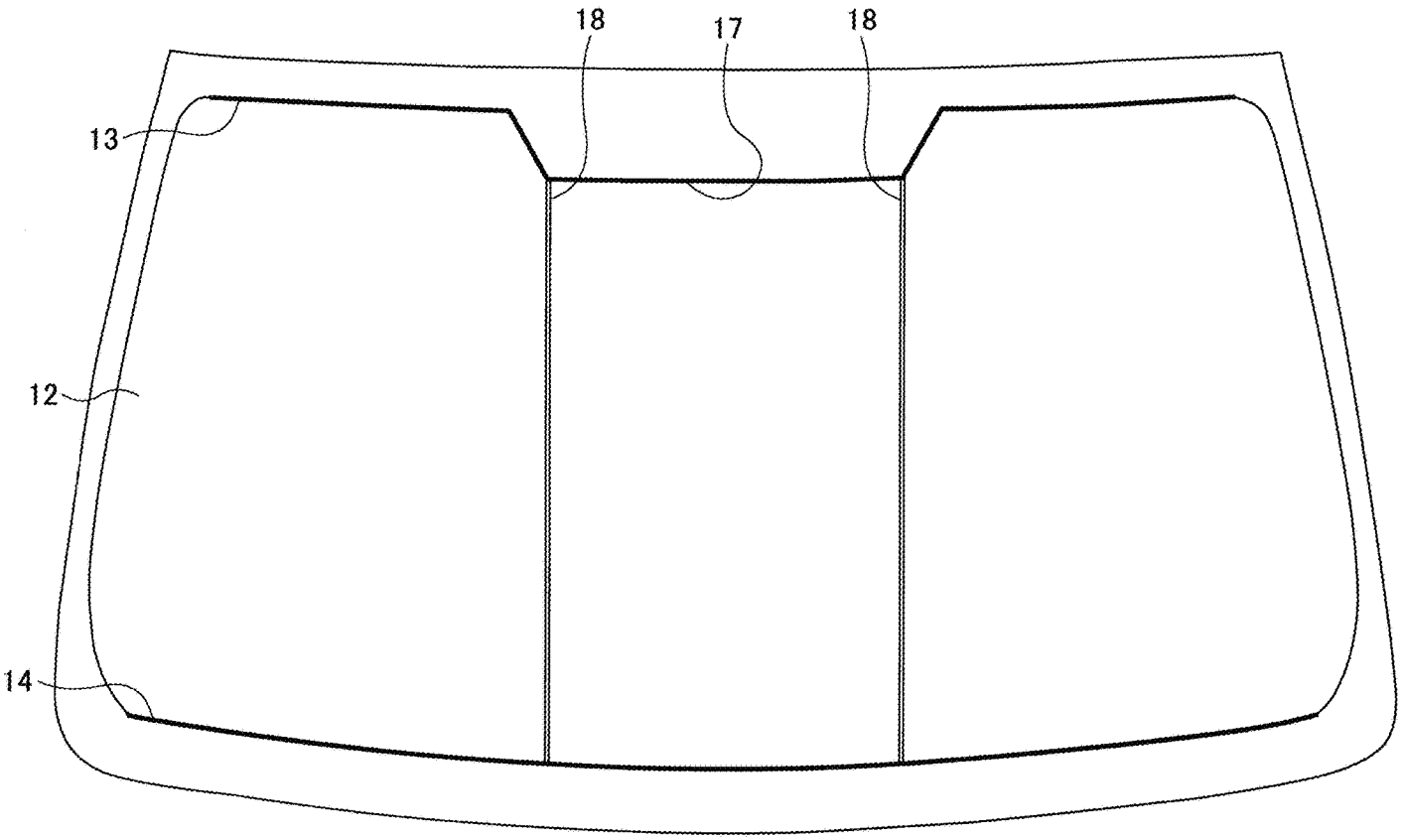
FIG. 15 is a schematic diagram illustrating the dimension and shape of laminated glass according to a fifth sample.
Figure 16:
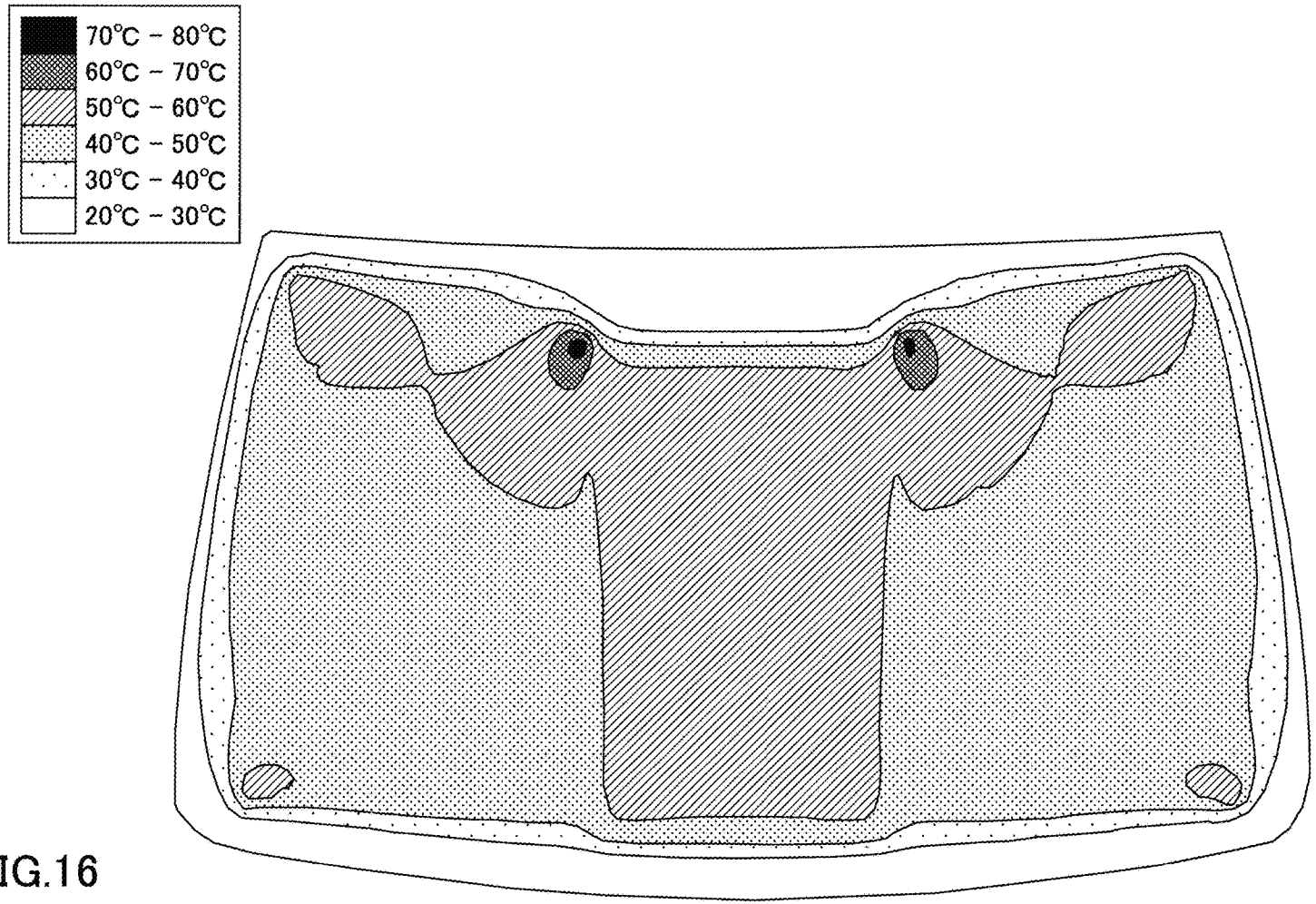
FIG. 16 is a schematic diagram illustrating temperature distribution of laminated glass according to the fifth sample when voltage is applied.
Figure 17:
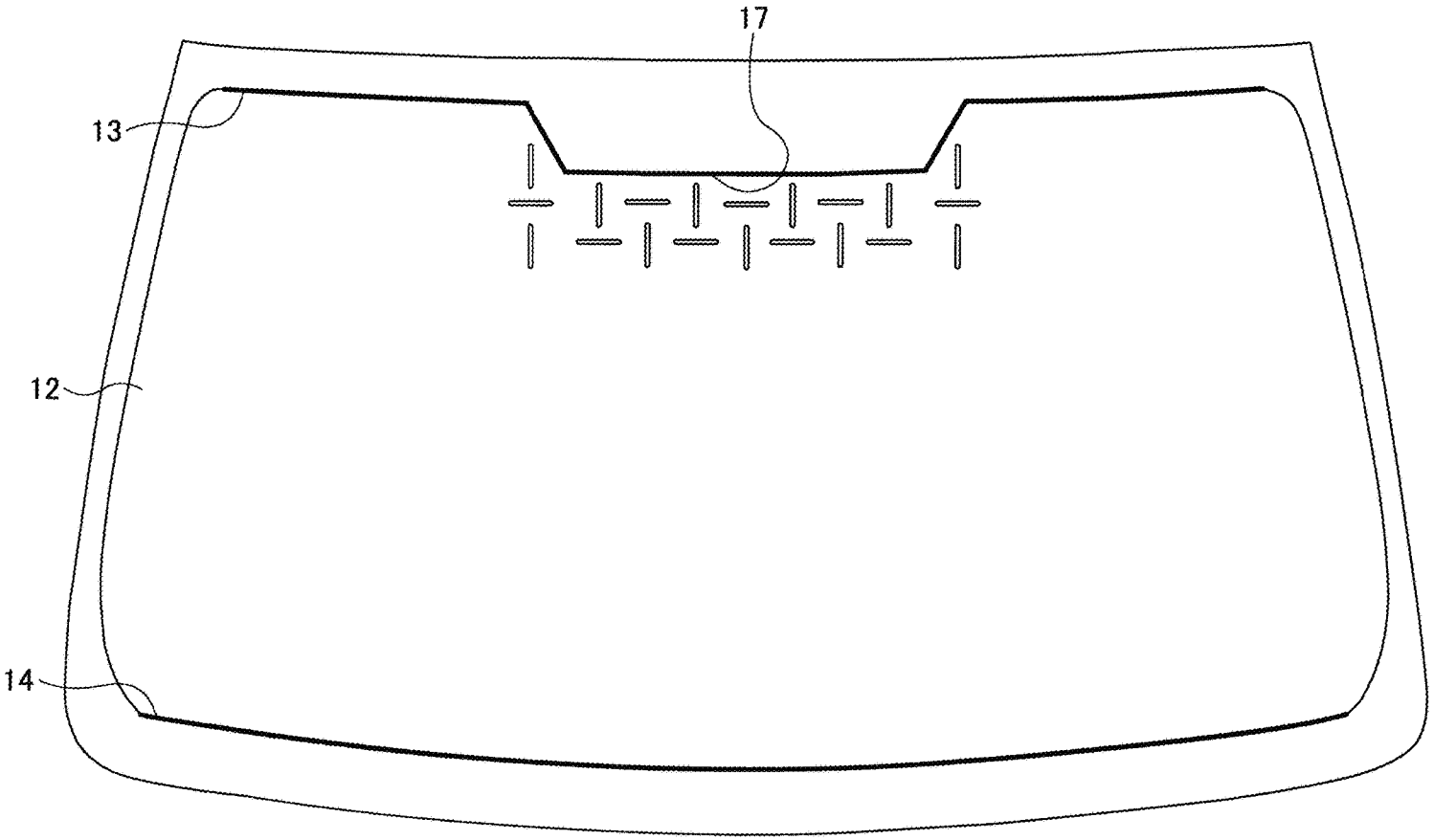
FIG. 17 is a schematic diagram illustrating the dimension and shape of laminated glass according to a sixth sample.
Figure 18:
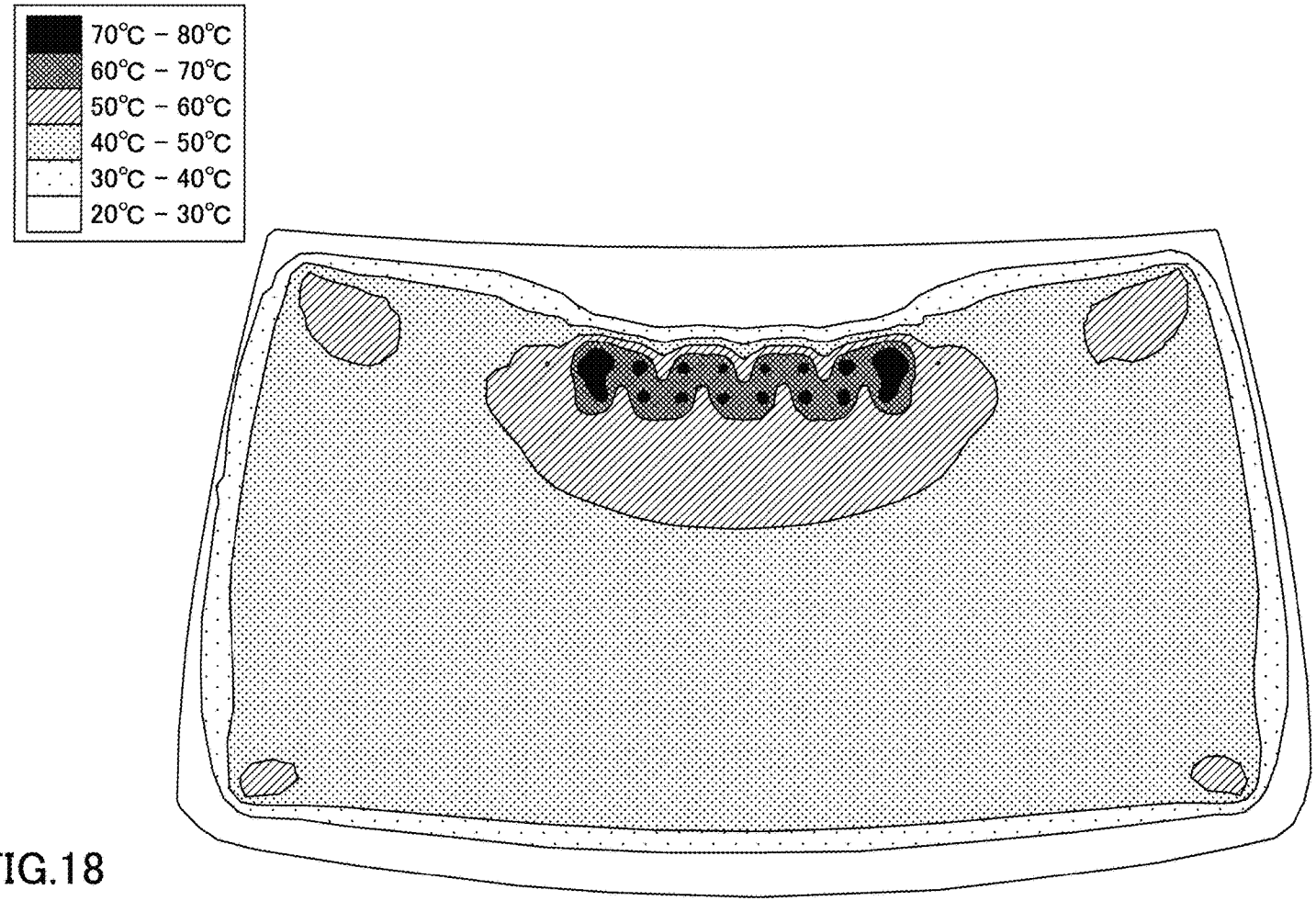
FIG. 18 is a schematic diagram illustrating temperature distribution of laminated glass according to the sixth sample when voltage is applied.

FIG. 11 is a schematic diagram illustrating the dimension and shape of laminated glass according to the third sample. FIG. 12 is a schematic diagram illustrating temperature distribution of laminated glass according to the third sample when voltage is applied. FIG. 13 is a schematic diagram illustrating the dimension and shape of laminated glass according to the fourth sample. FIG. 14 is a schematic diagram illustrating temperature distribution of laminated glass according to the fourth sample when voltage is applied. FIG. 15 is a schematic diagram illustrating the dimension and shape of laminated glass according to the fifth sample. FIG. 16 is a schematic diagram illustrating temperature distribution of laminated glass according to the fifth sample when voltage is applied. FIG. 17 is a schematic diagram illustrating the dimension and shape of laminated glass according to the sixth sample. FIG. 18 is a schematic diagram illustrating temperature distribution of laminated glass according to the sixth sample when voltage is applied. In FIGS. 11, 13, 15, and 17, reference numeral 12 indicates a transparent conductive film, reference numeral 13 indicates an upper bus bar, reference numeral 14 indicates a lower bus bar, reference numeral 17 indicates a recess, and the other numerals indicate dimensions (mm). In FIGS. 12, 14, 16, and 18, the symbol "-" representing a numeric range indicates that the value on its left side is included whereas the value on the right side is not included. For example, "20° C.-30° C." indicates a range that is greater than or equal to 20° C. but less than 30° C.

In the third to sixth samples, the analysis is performed under the same conditions except for the opening patterns of the transparent conductive film 12. In the third sample, an opening pattern similar to the opening pattern of FIG. 4 is formed in a lower part of a region interposed between the recess 17 of the upper side of the transparent conductive film 12 and the lower side of the transparent conductive film 12 and also in the lower parts of the regions provided on both sides of the region. In the fourth sample, no opening pattern is formed in the transparent conductive film 12. In the fifth sample, two slits 18 penetrating the transparent conductive film 12 in the vertical direction is formed. One silt 18 passes a left edge of a bottom of the recess 17 whereas the other slit 18 passes a right edge of the bottom of the recess 17. In the sixth sample, an opening pattern similar to the opening pattern of FIG. 4 is formed in an upper part of a region interposed between the recess 17 of the upper side of the transparent conductive film 12 and the lower side of the transparent conductive film 12.

As shown in FIGS. 11-18, it can be understood that local regions being heated to high temperature becomes smaller in the third sample compared to the fourth to sixth sample because an opening pattern is formed in a lower part of a region interposed between the recess of the upper side of the transparent conductive film 12 and the lower side of the transparent conductive film 12. Thus, the problem of local regions being heated to high temperatures is significantly improved. On the other hand, because no opening pattern is formed in the transparent conductive film 12 in the fourth sample, a large region is heated to high temperature when voltage is applied. Further, in the fifth sample, although the region interposed between the recess 17 and the lower side of the transparent conductive film 12 is separated from other regions, a sidewall of the recess 17 has an inclined part that causes the length of the electric current path of the sidewall part of the recess 17 to be different from the lengths of the electric current paths of other parts and lead to concentration of electric current at a corner part of the sidewall of the recess 17. Thus, a large region is heated to high temperature when voltage is applied. In the sixth sample, although an opening pattern is formed in an upper part of the region interposed between the recess 17 of the upper side of the transparent conductive film 12 and the lower side of the transparent conductive film 12, electric current flowing in the vicinity of the recess 17 may concentrate at the upper part of the region where the opening pattern is formed and merge with the electric current that bypass the opening pattern. Thus, electric current may concentrate at this region and lead to a large region being heated to high temperature when voltage is applied.

Although embodiments of an electrically-heated window sheet material has been described above, the present invention is not limited to these embodiments, but variations and modifications may be made without departing from the scope of the present invention.

For example, the transparent conductive film 12 of the above-described embodiment has an upper side that is shorter than its lower side as illustrated in FIG. 1. However, the upper side may be longer than the lower side. Alternatively, the length of the upper side and the length of the lower side may be the same.

Further, the upper and lower bus bars 13, 14 of the above-described embodiment extend from the left end to the right end of the transparent conductive film 12, respectively. However, the upper and lower bus bars 13, 14 may be divided into multiple parts throughout the right end to the left end of the transparent conductive film 12.

Further, not only may vertically polarized waves and horizontally polarized waves be allowed to transmit the multiple openings of the above-described embodiment but also circularly polarized waves may be transmitted.

Further, the first region 21 of the above-described embodiment is integrally formed with the second and third regions 22, 23. However, the first region 21 may be provided apart from the second and third regions 22, 23.

Hence, with the above-described embodiment of the present invention, there can be provided an electrically-heated window sheet material that improves the problem of local regions being heated to high temperatures.

The invention claimed is:

1. An electrically-heated window sheet material, comprising:

a heatable transparent conductive film having an upper side and a lower side; and a plurality of bus bars positioned to supply electricity to the transparent conductive film and comprising an upper bus bar and a lower bus such that the upper bus bar is connected to the upper side of the transparent conductive film and the lower bus bar is connected to the lower side of the transparent conductive film, wherein the transparent conductive film has a first region formed in a band shape extending between the upper and lower bus bars such that the upper side of the transparent conductive film has a recess portion formed in the first region and recessed toward the lower side of the transparent conductive film and that the transparent conductive film has a plurality of openings formed in the first region and positioned in a portion of the first region within 400 mm from the lower side of the transparent conductive film along the lower side of the transparent conductive film to face the recess portion and to generate a current flow bypassing the openings between the upper and lower bus bars, the transparent conductive film has a second region formed in a band shape extending between the upper and lower bus bars and a third region formed in a band shape extending between the upper and lower bus bars such that the first region is interposed between the second and third regions, and the transparent conductive film includes a frequency selective surface in the first region such that the frequency selective surface transmits a vertically polarized electromagnetic wave of a predetermined frequency through the plurality of openings.

2. The electrically-heated window sheet material as claimed in claim 1, wherein the plurality of openings includes a plurality of first openings and a plurality of second openings formed at spaced-intervals in a vertical direction of the transparent conductive film, and a plurality of third openings formed such that a respective one of the third openings is positioned to contact or overlap with a region extending between respective ones of the first and second openings.

3. The electrically-heated window sheet material as claimed in claim 1, wherein the plurality of openings is formed in a staggered manner in a vertical direction of the transparent conductive film.

4. The electrically-heated window sheet material as claimed in claim 1, wherein each of the openings has a horizontal dimension of greater than or equal to $(1/2)\cdot\lambda_g$, and the electrically-heated window sheet material has a wavelength of $\lambda_g=\lambda_0\cdot k$ where $\lambda_0$ is an atmospheric wavelength of a center frequency of a frequency band of the predetermined frequency, and k is a shortening coefficient of wavelength by the electrically-heated window sheet material.

5. The electrically-heated window sheet material as claimed in claim 1, wherein the plurality of openings includes a plurality of vertical openings each having a vertical dimension.

6. The electrically-heated window sheet material as claimed in claim 1, wherein the plurality of openings includes a plurality of cross openings each having a linear vertical opening and a linear horizontal opening intersecting the linear vertical opening.

7. The electrically-heated window sheet material as claimed in claim 1, wherein the plurality of openings includes a plurality of linear vertical openings and a plurality of linear horizontal openings spaced apart from the linear vertical openings, respectively.

8. The electrically-heated window sheet material as claimed in claim 1, wherein the transparent conductive film is formed such that the plurality of openings is formed in a portion of the first region within 300 mm from the lower side of the transparent conductive film.

9. The electrically-heated window sheet material as claimed in claim 1, wherein the transparent conductive film is formed such that the plurality of openings is formed in a portion of the first region within 200 mm from the lower side of the transparent conductive film.

10. The electrically-heated window sheet material as claimed in claim 1, wherein the transparent conductive film is formed such that the plurality of openings includes a plurality of horizontally elongated openings extending along the other one of the bus bars in a horizontal direction of the transparent conductive film.

11. The electrically-heated window sheet material as claimed in claim 3, wherein each of the openings has a horizontal dimension of greater than or equal to $(1/2)\sim\lambda_g$, and the electrically-heated window sheet material has a wavelength of $\lambda_g=\lambda_0\cdot k$ where $\lambda_0$ is an atmospheric wavelength of a center frequency of a frequency band of the predetermined frequency, and k is a shortening coefficient of wavelength by the electrically-heated window sheet material.

12. The electrically-heated window sheet material as claimed in claim 2, wherein the transparent conductive film is formed such that the plurality of openings is formed in a portion of the first region within 300 mm from the lower side of the transparent conductive film.

13. The electrically-heated window sheet material as claimed in claim 2, wherein the transparent conductive film is formed such that the plurality of openings is formed in a portion of the first region within 200 mm from the lower side of the transparent conductive film.

14. The electrically-heated window sheet material as claimed in claim 3, wherein the transparent conductive film is formed such that the plurality of openings is formed in a portion of the first region within 300 mm from the lower side of the transparent conductive film.

15. The electrically-heated window sheet material as claimed in claim 3, wherein the transparent conductive film is formed such that the plurality of openings is formed in a portion of the first region within 200 mm from the lower side of the transparent conductive film.

16. The electrically-heated window sheet material as claimed in claim 11, wherein the transparent conductive film is formed such that the plurality of openings is formed in a portion of the first region within 300 mm from the lower side of the transparent conductive film.

17. The electrically-heated window sheet material as claimed in claim 11, wherein the transparent conductive film is formed such that the plurality of openings is formed in a portion of the first region within 200 mm from the lower side of the transparent conductive film.

18. The electrically-heated window sheet material as claimed in claim 4, wherein the transparent conductive film is formed such that the plurality of openings is formed in a portion of the first region within 300 mm from the lower side of the transparent conductive film.

19. The electrically-heated window sheet material as claimed in claim 5, wherein the transparent conductive film is formed such that the plurality of openings is formed in a portion of the first region within 300 mm from the lower side of the transparent conductive film.

20. The electrically-heated window sheet material as claimed in claim 6, wherein the transparent conductive film is formed such that the plurality of openings is formed in a portion of the first region within 300 mm from the lower side of the transparent conductive film.

* * * * *